United States Patent [19]

Brentini

[11] 4,309,883

[45] Jan. 12, 1982

[54] RING FOR ATTACHMENT TO KEYS OR OTHER OBJECTS

[76] Inventor: Attilio Brentini, "Le Château", Crissier (Vaud), Switzerland

[21] Appl. No.: 60,211

[22] Filed: Jul. 23, 1979

Related U.S. Application Data

[63] Continuation-in-part of Ser. No. 940,854, Sep. 8, 1978, abandoned.

[30] Foreign Application Priority Data

Mar. 3, 1978 [CH] Switzerland ..... 2316/78

[51] Int. Cl.[3] ..... A44B 15/00; A45C 13/42

[52] U.S. Cl. ..... 70/456 R; 40/2 A

[58] Field of Search ..... 40/2 A, 6; 70/456 R, 70/457, 458, 459; 428/101; 150/40

[56] References Cited

U.S. PATENT DOCUMENTS

| | | | |
|---|---|---|---|
| 474,725 | 5/1892 | Dwigans | 40/2 A |
| 1,008,203 | 11/1911 | Schumacher | 70/459 |
| 1,368,743 | 2/1921 | Nielsen | 40/2 A |
| 1,443,889 | 1/1923 | Williams | 40/2 A |
| 1,745,333 | 1/1930 | Read | 150/40 |
| 2,511,651 | 6/1950 | Schlitz | 40/2 A |
| 2,687,756 | 8/1954 | Felt | D3/61 X |
| 3,908,418 | 9/1975 | Stoffel | 70/456 R |
| 3,956,913 | 5/1976 | Howard | 70/459 X |

FOREIGN PATENT DOCUMENTS

| | | | |
|---|---|---|---|
| 424053 | 3/1911 | France . | |
| 1481078 | 4/1967 | France . | |
| 1481644 | 4/1967 | France . | |
| 1482373 | 4/1967 | France . | |
| 1482475 | 4/1967 | France | 70/459 |
| 2160333 | 6/1973 | France . | |
| 892002 | 3/1962 | United Kingdom | 70/456 B |

*Primary Examiner*—Henry F. Epstein

*Attorney, Agent, or Firm*—Emory L. Groff, Jr.

[57] ABSTRACT

A two part ring, such as a key ring, is provided wherein each part includes a flat body portion with an annular part extending from the body portion to define an open area. Male and female attachment means are located on the body portions. A gap is provided in each annular part and is so located therein that, when the two parts are pressed together to connect said attachment means, each gap lies opposite an unopen section of the other annular part to thereby provide a closed ring.

4 Claims, 3 Drawing Figures

RING FOR ATTACHMENT TO KEYS OR OTHER OBJECTS

This is a continuation of application Ser. No. 940,854 filed Sept. 8, 1978, now abandoned.

This invention relates to an article comprising an open ring for attachment to an object through an opening formed in the object. Objects with which the invention may be used comprise for example, key rings, identification tags for attachment to luggage or other baggage or clothing and price tags for attachment to certain merchandise.

The object of the invention is to provide particularly simple and inexpensive articles of the foregoing type.

The article according to the invention comprises an open ring adapted to be inserted into an opening in an object. The ring includes two annular sections that are open and movable in relation to each other and fastening means capable of holding these two parts together in a position such that the open portions are staggered so that each open portion is located opposite a non-open portion of the other part. Each annular part is made of injected plastic material and the fastening means is disposed on the faces that are pressed against each other.

The attached drawing shows schematically and by way of example two ways of making the article according to the invention.

Figure 1:
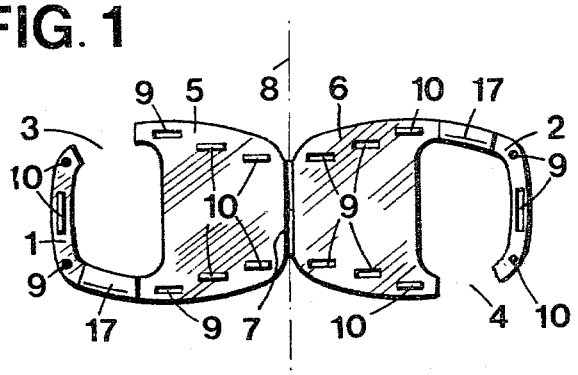
FIG. 1 shows an open key ring according to the first form of execution.
Figure 2:
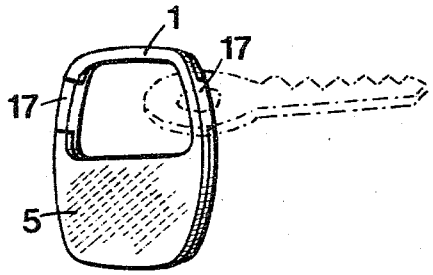
FIG. 2 shows the key ring of FIG. 1 in its closed position.

The key ring illustrated in FIGS. 1 and 2 shows two annular parts 1 and 2 each having an opening or gap 3,4 respectively. Each annular part is joined to a related plate 5,6 respectively. These two plates are joined by a part 7 of lesser thickness than the plates and comprises means for hinging one plate in relation to another along an axis 8. It may be seen that this axis 8 is essentially parallel to the plane of the annular parts 1 and 2 and extends beyond them.

The projections 10, disposed on the annular parts 1 and 2 and on the plates 5 and 6, are adapted to be inserted by force into the small grooves 9 of the opposite parts or plates.

In addition, the annular parts 1 and 2 each feature a lateral projection 17 which fits into the opening 4 or 3, respectively, in the opposite annular part to fill the gap formed by said opening. Thus, the outside surface of each of the two annular parts 1 and 2, when in juxtaposed position, is substantially smooth.

In order to attach a key to the key ring, it is inserted in the opening formed by the open portion 3, after which it is shifted to the annular part 1 to bring it into a position in which, by folding together the plates 5 and 6, the key is opposite the open portion 4. In this position the projections 10 and the grooves 9 cooperate to provide a series of snap fasteners. It can readily be seen that the openings 3 and 4 are staggered with respect to each other, so that the keys inserted on the key ring cannot be removed as long as the annular parts 1 and 2 are held together as shown in FIG. 2.

Figure 3:
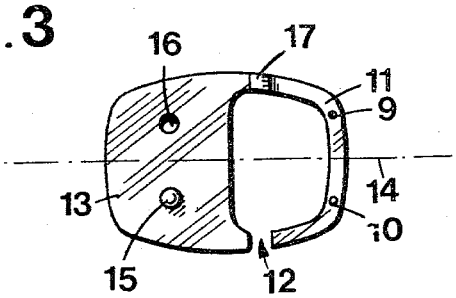
FIG. 3 is a view of one part of a detachable tag according to a second form of execution.

FIG. 3 shows one of the component parts of a tag that is formed by assembling two such identical parts. Each of these parts comprises an annular portion 11 with an opening 12, portion 11 being adjacent to a plate 13. The plate has a symmetrical axis 14 on each side of which are disposed connecting elements comprising a convex nipple 15 and a recess 16. In addition, the annular part 11 includes a laterally disposed projection 17 located symmetrically to the opening 12 with respect to the axis 14. It is evident that, taking two identical parts they can be coupled to each other by inserting the nipple 15 of each part into the recess 16 of the other part. At the same time, each projection 17 of an annular part 11 is inserted into the opening 12 of the other part 11 and closes the opening. Thus, the outside surface of the two juxtaposed parts 11 is practically smooth. The plate 13 can be printed on or can be made of a material on which one can write if necessary.

It is quite evident that the fastening means could simply be constituted by the projections 17 which would be shaped so as to provide a catch when inserted into the openings 12.

In another embodiment, the fastening means for holding the annular parts together could be magnetic and produced, for example, by embedding magnetic elements in said annular parts, or by using a plastic material containing magnetized powder.

I claim:

1. A two part article including a ring, each said part including a flat body portion and an annular part extending from the body portion to define an open area, hinge means connecting said body portions at a point opposite said annular parts, each annular part having a gap therein, male and female attachment means on each said body portion and each said annular part, said attachment means comprising at least one groove and at least one projection on each said body portion and each said annular part, said gaps located on each of said annular parts in such a position that when said parts are folded along said hinge means toward each other and pressed together, said male and female attachment means are connected and each gap overlies an unopen section of the facing annular part to thereby provide a closed ring.

2. A two part article according to claim 1 wherein, said two parts are made of injected plastic material.

3. A two part article including a ring, each said part including a body portion and an annular part extending from the body portion, hinge means connecting said body portions, each annular part having a gap therein, male and female attachment means on each said body portion and each said annular part, said attachment means comprising at least one groove and at least one projection on each said body portion and each said annular part, said gaps located on each of said annular parts in such a position that when said parts are folded along said hinge means toward each other and pressed together, said male and female attachment means are connected and each gap overlies an unopen section of the facing annular part to thereby provide a closed ring.

4. A two part article according to claim 3 wherein, the two parts are made of injected plastic material.

* * * * *